US008479966B2

(12) United States Patent
Chien et al.

(10) Patent No.: US 8,479,966 B2
(45) Date of Patent: Jul. 9, 2013

(54) FLOATING IMPACT APPARATUS FOR ELECTRICAL NAIL GUN

(75) Inventors: Chia-Yu Chien, Taichung (TW); Chien-Kuo Po, Taichung (TW); Chich-Ming Fan, Taichung (TW)

(73) Assignee: Basso Industry Corp., Taichung (TW)

( * ) Notice: Subject to any disclaimer, the term of this patent is extended or adjusted under 35 U.S.C. 154(b) by 230 days.

(21) Appl. No.: 13/093,647

(22) Filed: Apr. 25, 2011

(65) Prior Publication Data

US 2011/0259938 A1 Oct. 27, 2011

(30) Foreign Application Priority Data

Apr. 27, 2010 (TW) ..... 99113274 A

(51) Int. Cl.
*B25C 5/15* (2006.01)

(52) U.S. Cl.
USPC ..... 227/131; 227/133; 173/124; 173/205

(58) Field of Classification Search
USPC .. 227/2, 8, 131, 133, 134, 120, 129; 173/124, 173/205, 122
See application file for complete search history.

(56) References Cited

U.S. PATENT DOCUMENTS 4,625,903 A * 12/1986 Becht ..... 227/131
4,964,558 A * 10/1990 Crutcher et al. ..... 227/8
5,320,270 A * 6/1994 Crutcher ..... 227/131
5,511,715 A * 4/1996 Crutcher et al. ..... 227/131
5,720,423 A * 2/1998 Kondo et al. ..... 227/130
6,669,072 B2 * 12/2003 Burke et al. ..... 227/131
6,971,567 B1 * 12/2005 Cannaliato et al. ..... 227/2
7,121,443 B2 * 10/2006 Sun et al. ..... 227/131
7,325,711 B2 * 2/2008 Schiestl et al. ..... 227/131
7,334,715 B2 * 2/2008 Oda et al. ..... 227/2
7,575,141 B1 * 8/2009 Liang et al. ..... 227/131
7,726,536 B2 * 6/2010 Gross et al. ..... 227/134
8,136,606 B2 * 3/2012 Krondorfer et al. ..... 227/131
8,210,409 B2 * 7/2012 Hirabayashi ..... 227/131
8,336,748 B2 * 12/2012 Hlinka et al. ..... 227/8
2005/0218181 A1 10/2005 Gross et al.

* cited by examiner

*Primary Examiner* — Scott A. Smith
(74) *Attorney, Agent, or Firm* — Holland & Hart LLP

(57) ABSTRACT

A floating impact apparatus for an electrical nail gun includes a carrier, an impact unit, and a floating unit. The impact unit includes an impact member, and at least one sliding, wheel disposed pivotally on the impact member. The floating unit includes a guiding rod together with the impact member being connected movably to the carrier, two floating members extending through the carrier to connect with the guiding rod at positions proximate to a first side of the carrier, and at least two resilient members disposed between a second side of the carrier and the floating members for biasing the guiding rod and the impact member to move relative to the carrier to thereby maintain contact between the sliding wheel and the first side of the carrier, so as to promote smooth movement and nail-striking force of the impact member.

4 Claims, 6 Drawing Sheets

FLOATING IMPACT APPARATUS FOR ELECTRICAL NAIL GUN

CROSS-REFERENCE TO RELATED APPLICATION

This application claims priority of Taiwanese Application No. 099113274, filed on Apr. 27, 2010.

BACKGROUND OF THE INVENTION

1. Field of the Invention

This invention relates to an electrical nail gun, and more particularly to a floating impact apparatus for an electrical nail gun.

2. Description of the Related Art

Referring to FIG. 1, a first Conventional nail gun 1 disclosed in Taiwanese publication No. 200924918 (corresponding to U.S. Pat. No. 7,575,141) includes a supporting bracket 11, a sliding base 12 movable on the supporting bracket 11 along a nail-striking direction, a swing base 13 disposed pivotally on the supporting bracket 11, an electric driver 14 for driving the swing base 13 to swing relative to the sliding base 12, a motor 15 attached to the swing base 13, and a flywheel 16 driven by the motor 15.

When the motor 15 is energized, it drives the flywheel 16 to rotate. Subsequently, when a trigger unit (not shown) is actuated, the electric driver 14 drives the swing base 13, the motor 15, and the flywheel 16 to move toward the sliding base 12. As soon as the flywheel 16 comes into contact with the sliding base 12, the sliding base 12 moves at a high speed along the nail-striking direction, thereby finishing a nail-striking operation.

However, since the motor 15 is relatively heavy due to the fact it includes many components, such as a stator and a rotor, when it cooperates with the flywheel 16 to constitute the load of the swing base 13, a pushing force required for the electric driver 14 to swing the swing base 13 must be large sufficient to overcome the total weight of the motor 15 and the flywheel 16. Moreover, a pressing force provided by the sliding base 12 to the flywheel 16 may be too small to achieve smooth movement and a good nail-striking operation of the sliding base 12.

To solve this problem, in a second conventional nail gun disclosed in US Patent Application No. 20050218181, a motor is mounted on a back bone. As such, the load of an activation arm is reduced so as to allow the activation arm to swing smoothly. Upon, the swinging movement of the activation arm, a follower assembly is driven to push a driver to contact a flywheel. Hence, the driver is moved by the flywheel for nail firing.

However, since the driver is in a suspended state, and is disposed between the follower assembly and the flywheel. When in a normal position, the driver is in contact with the follower assembly at only an end thereof. Hence, when the driver is pushed by the follower assembly to contact the flywheel, the end of the driver sways due to application of a pushing force from the follower assembly thereto, thereby resulting in unsmooth movement of the driver, which leads to inaccurate nail-striking position. Besides, the second conventional electrical nail gun has disadvantages of complicated structure, difficult installation, maintenance, and repair, and high manufacturing costs, and is thus undesirable from an economical standpoint.

SUMMARY OF THE INVENTION

The object of this invention is to provide a floating impact apparatus that can promote smooth nail-striking operation and nail-striking force.

Accordingly, a floating impact apparatus of this invention is used for an electrical nail gun, and includes a carrier, an impact unit, and a floating unit. The impact unit includes an impact member, and at least one sliding wheel disposed pivotally on the impact member. The floating unit includes a guiding rod together with the impact member being connected movably to the carrier, two floating members extending through the carrier to connect with the guiding rod at positions proximate to a first side of the carrier, and at least two resilient members disposed between a second side of the carrier and the floating members for biasing the guiding rod and the impact member to move relative to the carrier to thereby maintain contact between the sliding wheel and the first side of the carrier, so as to promote smooth movement and nail-striking force of the impact member.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
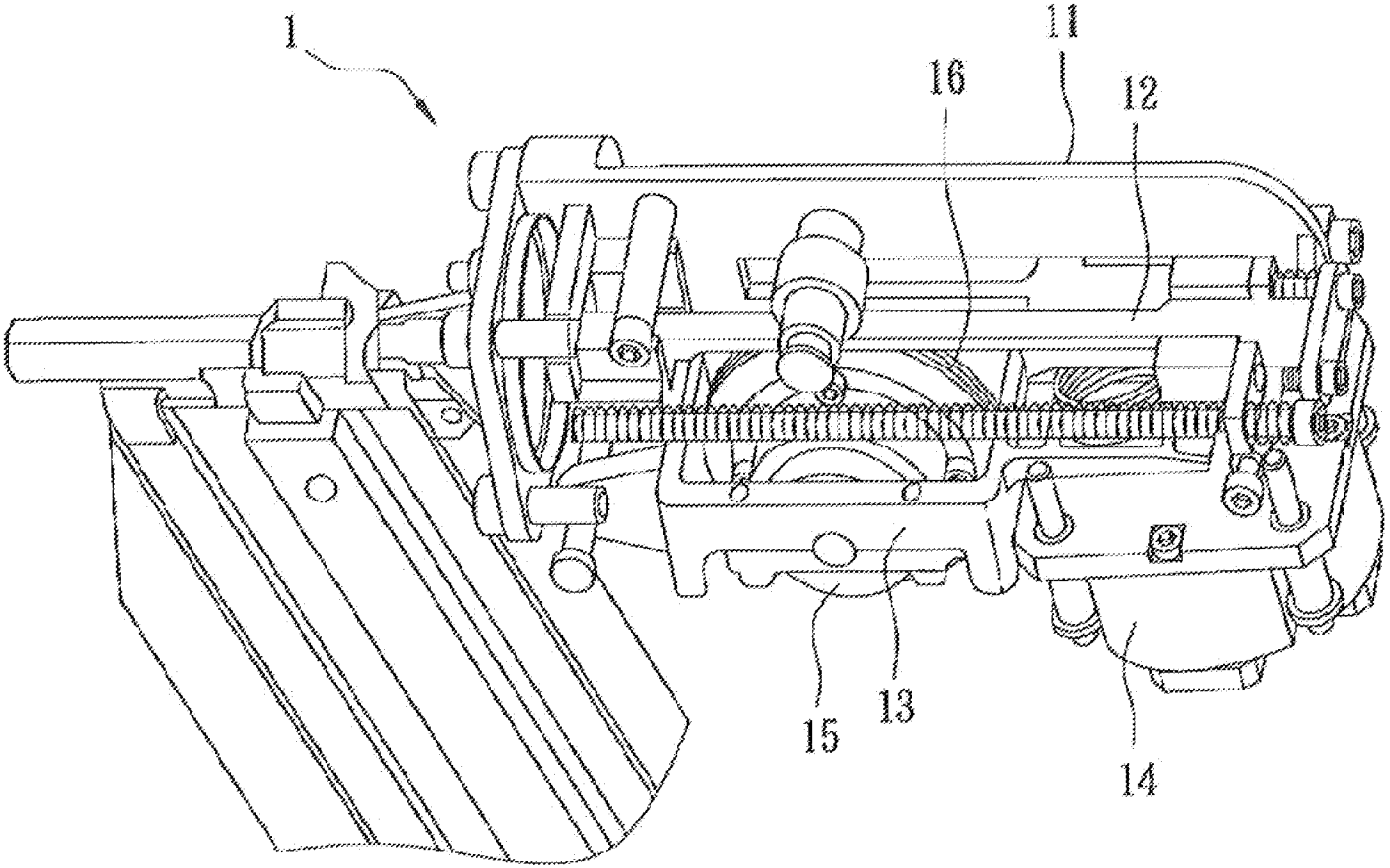
Prior Art FIG. 1
FIG. 1 is a perspective view of a conventional nail gun disclosed in Taiwanese publication No. 200924918.
Figure 2:
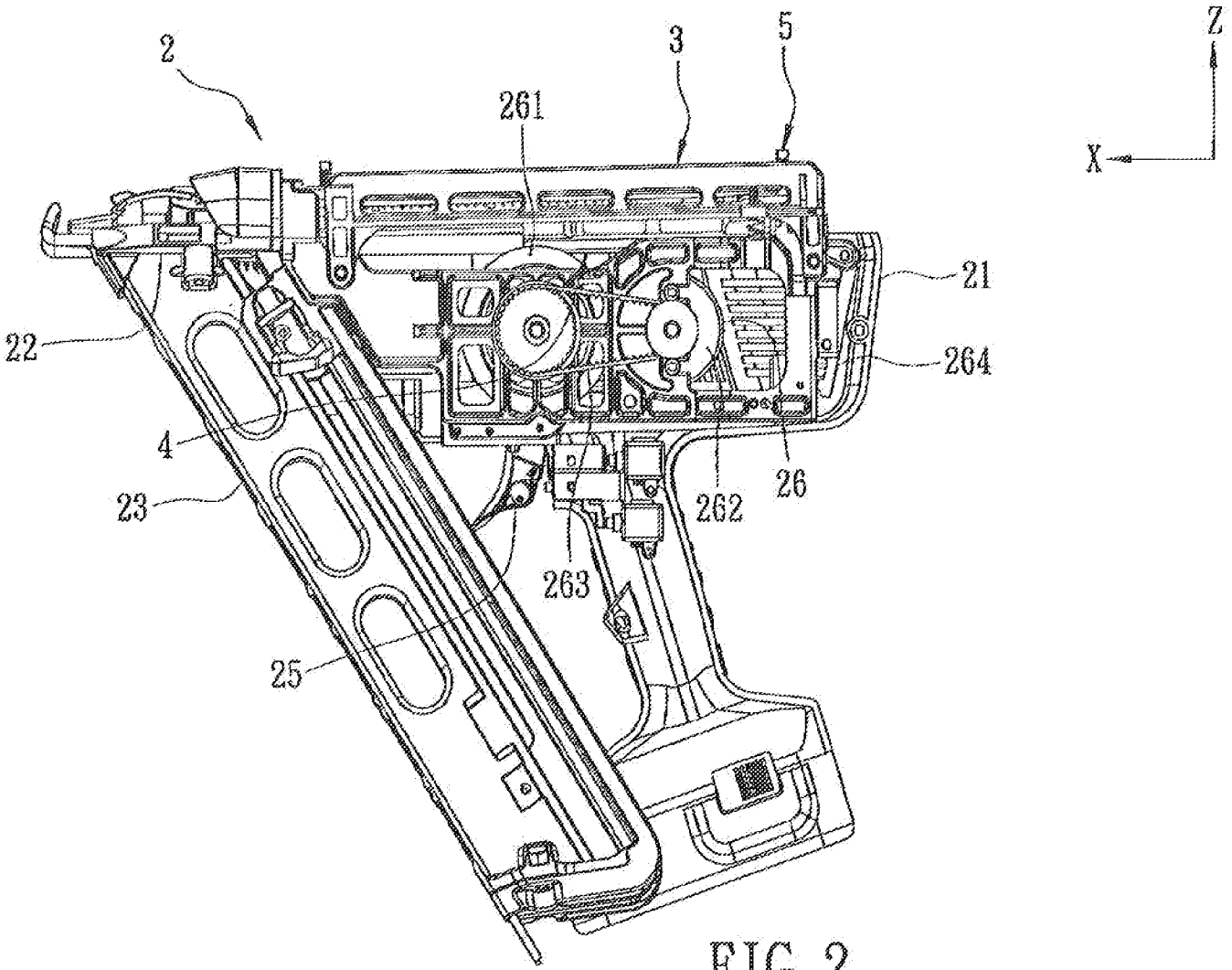
FIG. 2 is a schematic side view of a nail gun including the preferred embodiment of a floating impact apparatus according to this invention.
Figure 3:
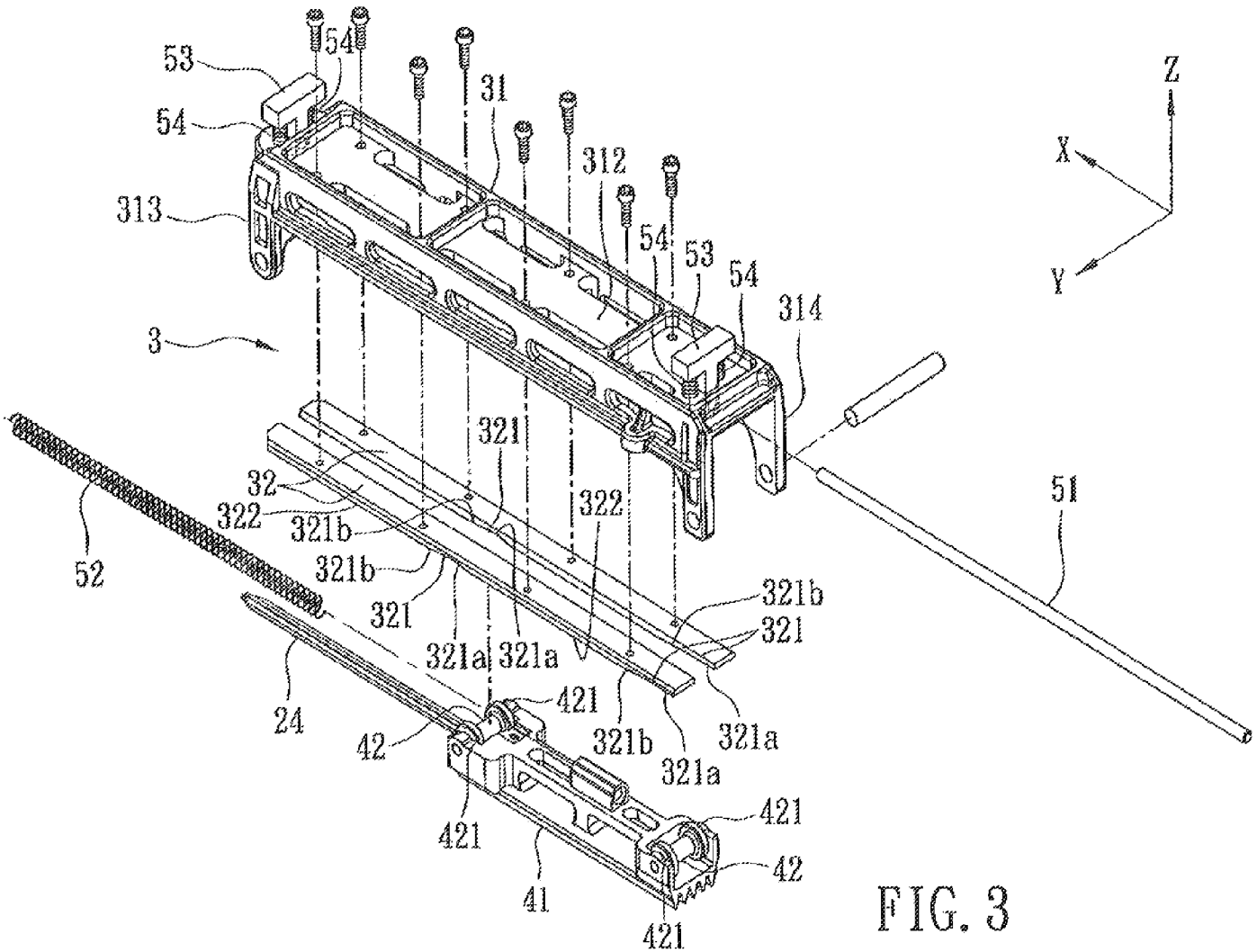
FIG. 3 is a partly exploded perspective view of the preferred embodiment.
Figure 4:
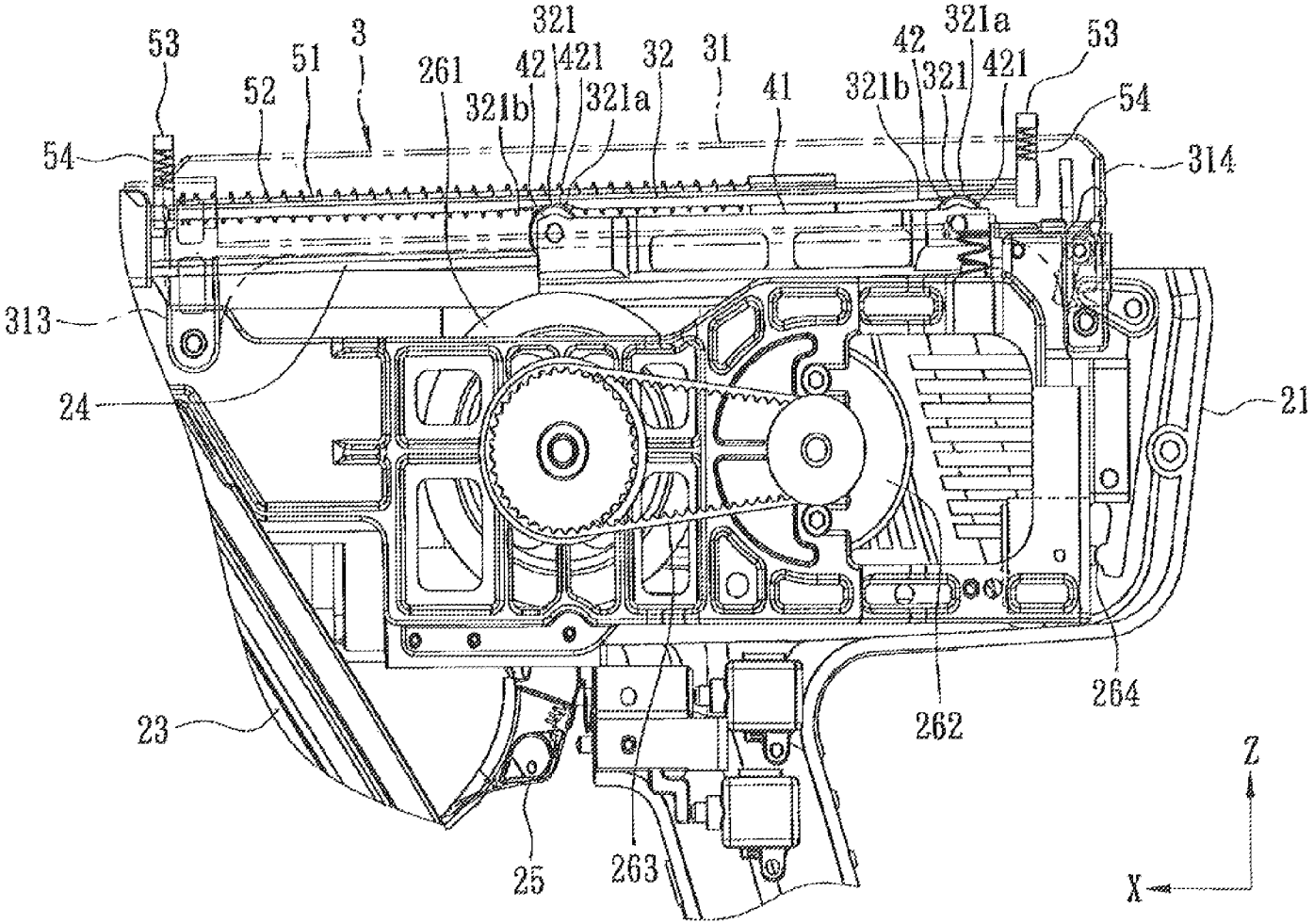
FIG. 4 is a schematic view illustrating an idle position of an impact member of the preferred embodiment.

Referring to FIGS. 2, 3, and 4, the preferred embodiment of a floating impact apparatus according to this invention is mounted to an electrical nail gun 2. The nail gun 2 includes a supporting bracket 21, a nail ejection seat 22 disposed on a front end portion of the supporting bracket 21, a magazine 23 connected to the nail ejection seat 22 for feeding nails (not shown) into the nail ejection seat 22, a striking bar 24 extending through and movable relative to the nail ejection seat 22 along an X-axis direction to impact the nails one at a time, a trigger unit 25 disposed pivotally on the supporting bracket 21 and operable to start a firing operation via a control circuit (not shown), and a transmission unit 26. The transmission unit 26 includes a flywheel 261 disposed pivotally on the supporting bracket 21, a motor 262 adjacent to the flywheel 261 and disposed on the supporting bracket 21, a transmission belt 263 for transmitting power from the motor 262 to the flywheel 261, and a solenoid valve 264 mounted to the supporting bracket 21. The floating impact apparatus includes a carrier 3, an impact unit 4, and a floating unit 5.

The carrier 3 includes a swing arm 31 and two guiding rails 32. The swing arm 31 extends along the X-axis direction, is disposed on the supporting bracket 21, and has opposite first and second sides 311, 312 (see FIG. 6), a pivot end 313 disposed pivotally on the supporting bracket 21, and a free end 314 opposite to the pivot end 313. The guiding rails 32 extend along the X-axis direction, are parallel to each other, and are disposed fixedly on the first side 311 of the swing arm 31. Each of the guiding rails 32 has two inclined surfaces 321 and two flat passage surfaces 322 (see FIG. 3). The inclined surfaces 321 and the passage surfaces 322 face the flywheel 261. Each of the inclined surfaces 321 has a low point (321*a*) proximate to the first side 311 of the swing arm 31, and a high point (321*b*) distal from the first side 311 of the swing arm 31. The low and high points (321*a*, 321*b*) of each of the guiding rails 32 are opposite to each other along the nail-striking direction. The passage surfaces 322 are connected respectively to the high points (321*b*) of the inclined surfaces 321.

The floating unit 4 includes an impact member 41 and a plurality of sliding wheels 42. The impact member 41 is connected to the striking bar 24. The sliding wheels 42 are disposed pivotally on the impact member 41. Each of the sliding wheels 42 has two wheel surfaces 421 in sling contact with the guiding rails 32, respectively.

The floating unit 5 includes a guiding rod 51 extending through the impact member 91 along the X-axis direction, a first resilient member 52 sleeved on the guiding rod 51 and located between the pivot end 313 of the swing arm 31 and the impact member 41, two floating members 53 extending through the swing arm 31 along a Z-axis direction to connect with the guiding rod 51 at positions proximate to the first side 311 of the swing arm 31, and two pairs of second resilient members 54, each pair of which is disposed between the corresponding floating member 53 and the second side 312 of the swing arm 31.

Figure 5:
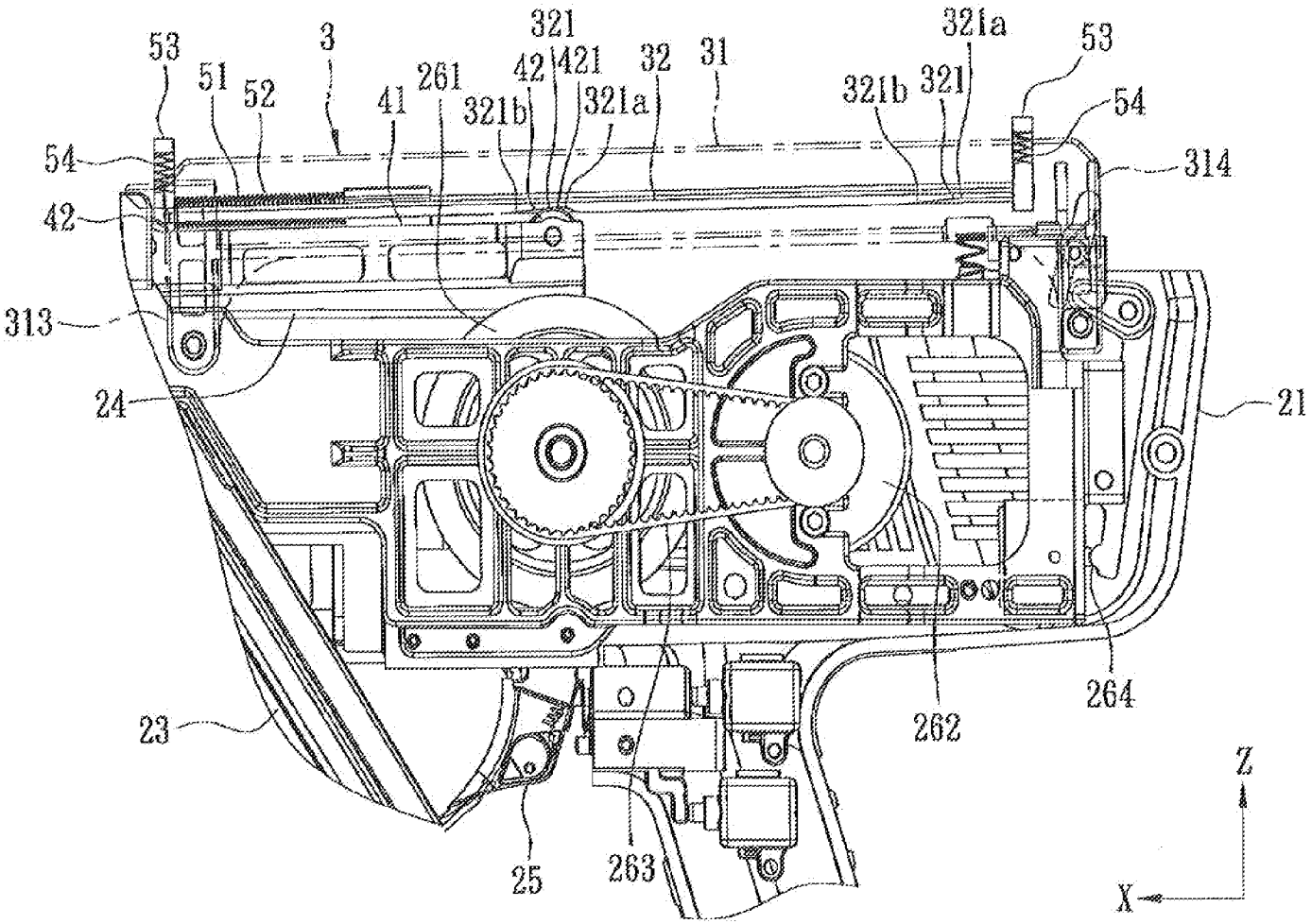
FIG. 5 is a view similar to FIG. 4 but illustrating a striking position of the impact member of the preferred embodiment.
Figure 6:
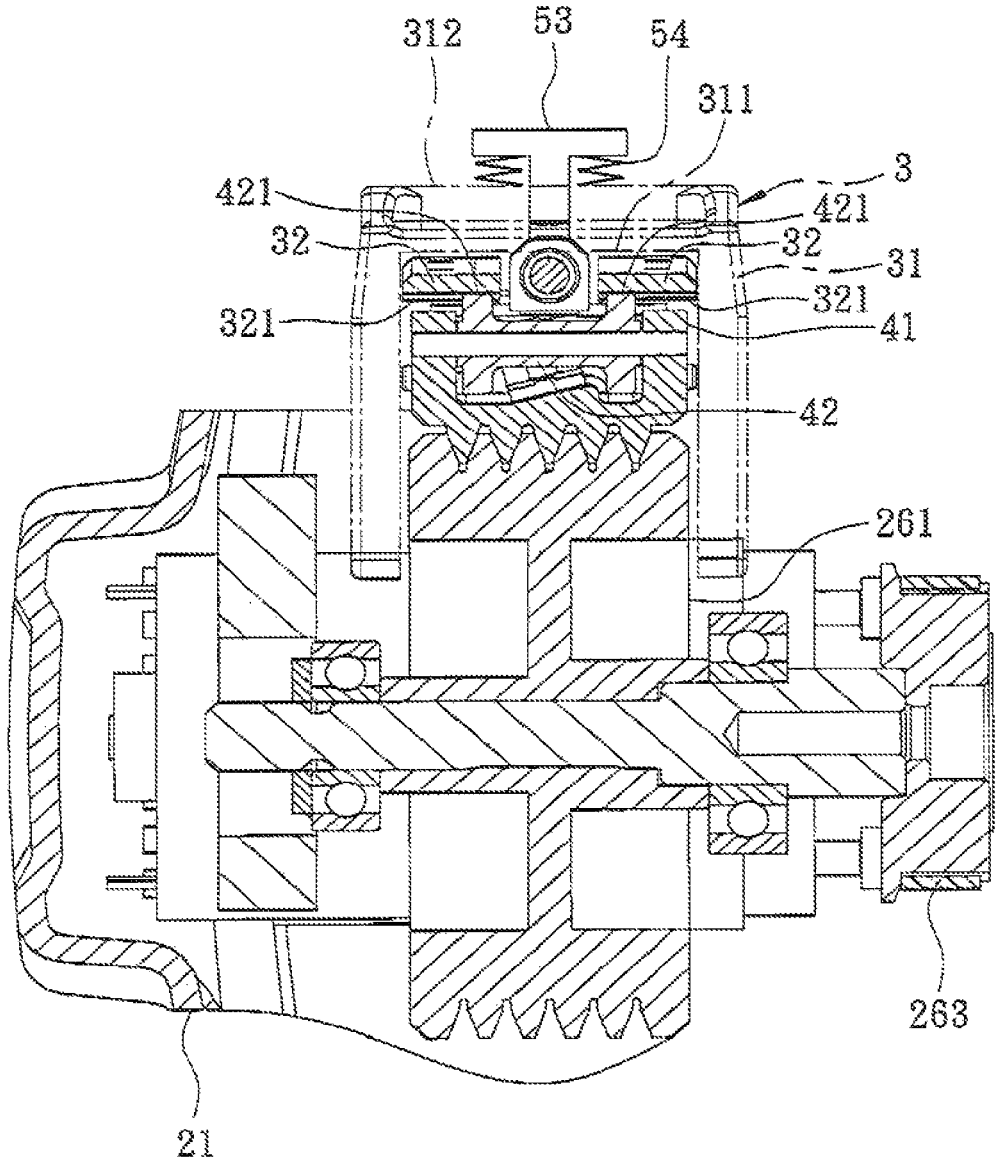
FIG. 6 is a sectional view of preferred embodiment, illustrating engagement between the impact member and a flywheel.

Referring to FIGS. 4, 5, and 6, when the electric nail gun 2 is not in use, the flywheel 261 is spaced apart from the impact member 41 by a distance of 0.5 mm. When the electrical nail gun 2 is powered on, the motor 262 drives idle rotation of the flywheel 261 via the transmission belt 263. At this time, it is only necessary for the user to operate the trigger unit 25. Through operation of the trigger unlit 25, a control circuit (not shown) is activated so that the solenoid valve 264 drives pivoting movement of the free end 314 of the swing arm 31 toward the flywheel 261. When the impact member 91 is moved with the free end 314 of the swing arm 31 to engage with the flywheel 261, the kinetic energy of the flywheel 261 is transmitted to the impact member 41 to overcome the biasing action of the first resilient member 52, thereby driving a high-speed movement of the wheel surfaces 421 of the sliding wheels 42 on the guiding rails 32, respectively, along the guiding rod 51 in the X-axis direction so that the striking bar 24 is moved to impact one of the nails.

Importantly, during the nail-firing operation, each of the sliding wheels 92 moves from the low point (321*a*) of the corresponding inclined surface 321 onto the high point (321*b*) of the corresponding inclined surface 321. Hence, the impact member 41 is moved toward the flywheel 261 along the Z-axis direction. When each of the sliding wheels 42 reaches the high point (321*b*) of the corresponding inclined surface 321, the impact member 41 is pressed against the flywheel 261 to result in pressing contact occurring therebetween, and is thus driven by the flywheel 261 to move along the passage surface 322 of the corresponding guiding rail 32 in the X-axis direction. Since the passage surfaces 322 are aligned with the high points (321*b*) of the inclined surfaces 321 along the X-axis direction, contact between the impact member 41 and the flywheel 261 can be maintained during movement of the impact member 41 along the X-axis direction to thereby avoid a loss in the nail-striking force.

Furthermore, since the guiding rod 51 together with the impact member 41 is moved toward the flywheel 261 along the Z-axis direction, the floating members 53 are moved to overcome the biasing action of the second resilient members 54 to maintain contact between the sliding wheels 42 and the guiding rails 32, thus promoting smooth movement of the impact member 41.

It should be noted that, when the nail-firing operation is completed, due to the biasing action of the first resilient member 52, each of the sliding wheels 321 is returned from the corresponding passage surface 322 onto the corresponding inclined surface 321 along the guiding rod 51. When each of the sliding wheels 321 reaches the high point (321*b*) of the corresponding inclined surface 321, due to the biasing action of the second resilient members 54, it moves from the high point (321*b*) of the corresponding inclined surface 321 onto the low point (321*a*) of the corresponding inclined surface 321. At this time, deactivation of the solenoid valve 264 results in movement of the free end 314 of the swing arm 31 away from the flywheel 261 due to the biasing action of additional springs (not shown) until the impact member 41 is spaced apart from the flywheel 261 by 0.5 mM. As a result, the impact member 41 is returned to its original position relative to the swing arm 31.

In view of the above, the floating impact apparatus of this invention has the following advantages:

1. The swing arm 31 is pivotable relative to the flywheel 261 for power-transmitting purposes. Since the swing arm 31 is loaded with only the impact unit 4 and the floating unit 5 that are relatively lightweight, smooth and accurate movement of the swing arm 31 can be ensured.
2. During the nail-striking operation, slidable contact between the sliding wheels 42 and the guiding rails 32 is maintained to promote smooth movement of the impact member 41. Furthermore, the carrier 3, the impact unit 4, and the floating unit 5 are arranged in such a manner to increase effectively a pressure occurring between the impact member 41 and the flywheel 261, thus allowing the electrical nail gun 3 to have a greater firing force.

With this invention thus explained, it is apparent that numerous modifications and variations can be made without departing from the scope and spirit of this invention. It is therefore intended that this invention be limited only as indicated by the appended claims.

We claim:

1. A floating impact apparatus for a nail gun, said floating impact apparatus comprising:

a carrier having opposite first and second sides;

an impact unit including an impact member movable in a nail-striking direction relative to said carrier as a result of application of a force thereto, and at least one sliding wheel disposed pivotally on said impact member and in sliding contact with said first side of said carrier; and a floating unit including a guiding rod extending along the nail-striking direction such that said guide rod together with said impact member is movable relative to said carrier, two floating members extending through said carrier to connect with said guiding rod at positions proximate to said first side of said carrier and distal from said second side of said carrier, and at least two resilient members disposed between said carrier and said floating member for biasing said guiding rod and said impact member to move relative to said carrier to thereby maintain contact between said sliding wheels and said first side of said carrier.

2. The floating impact apparatus as claimed in claim 1, wherein said carrier further has at least one inclined surface, said inclined surface having a low point proximate to said second side of said carrier, and a high point distal from said second side of said carrier.

3. The floating impact apparatus as claimed in claim 2, wherein said high and low points of said inclined surface are opposite to each other along said nail-striking direction.

4. The floating impact apparatus as claimed in claim 2, wherein said carrier further has a swing arm having said first and second sides, and two parallel guiding rails disposed fixedly on said first side of said carrier and having said inclined surface, said impact unit including two said sliding wheels each having two wheel surfaces that are in sliding contact with said guiding rails, respectively.

* * * * *